US006228493B1

(12) United States Patent
Kimura

(10) Patent No.: US 6,228,493 B1
(45) Date of Patent: May 8, 2001

(54) CONJUGATE FIBERS AND MANUFACTURING METHOD OF THE SAME

(75) Inventor: Yoshiharu Kimura, Ohmihachiman (JP)

(73) Assignee: Kyoto Institute of Technology, Kyoto (JP)

( * ) Notice: Subject to any disclaimer, the term of this patent is extended or adjusted under 35 U.S.C. 154(b) by 0 days.

(21) Appl. No.: 09/335,502

(22) Filed: Jun. 18, 1999

(30) Foreign Application Priority Data

Oct. 27, 1998 (JP) ..... 10-305622

(51) Int. Cl.[7] ..... D01F 8/00; D01F 8/14
(52) U.S. Cl. ..... 428/373; 428/374; 428/370
(58) Field of Search ..... 428/373, 374, 428/370

(56) References Cited

U.S. PATENT DOCUMENTS 4,307,151 * 12/1981 Yamauchi et al. ..... 428/373
5,593,778 * 1/1997 Kondo et al. ..... 428/373
5,990,266 * 11/1999 Tadros et al. ..... 528/288

FOREIGN PATENT DOCUMENTS 7-11519 1/1995 (JP) .
7-216656 8/1995 (JP) .
11-302926 11/1999 (JP) .

* cited by examiner

*Primary Examiner*—N. Edwards
(74) *Attorney, Agent, or Firm*—Venable; Marina V. Schneller

(57) ABSTRACT

A polyester fiber is provided, which does not produce a huge amount of residues during its reducing process, and shows good appearance, feeling and superior characteristics as a fiber, such as a high tensile strength and elongation. Such polyester fiber is a conjugate fiber comprising a core spinned from a polyester containing an aromatic moiety and a skin layer surrounding the core, the skin layer spinned from an aliphatic polyester. The skin layer may be easily reduced by contacting it with an alkaline solution or an enzyme, to provide a reduced fiber with good appearance, feeling and superior characteristics as a fiber.

17 Claims, 4 Drawing Sheets

CONJUGATE FIBERS AND MANUFACTURING METHOD OF THE SAME

BACKGROUND OF THE INVENTION

1. Field of the Invention

The invention relates to a conjugate fiber and a manufacturing method of the same.

2. Related Arts

An aromatic polyester containing an aromatic moiety, such as polyethylene terephthalate or polybuthylene terephthalate, has been considered to be not biodegradable and thus, in most cases, has been fired after the use. However, since such firing may induce environmental pollution, its effective treatment has been demanded.

On the other hand, a polyester fiber with its weight being reduced by means of an alkaline solution has been widely used as an material for an apparel, because of its good appearance and feeling. However, its reducing process includes a hydrolysis step providing residues, which require more troublesome treatments. Thus a polyester fiber has been demanded, which is free from the above problems associated with treatments of the residues.

SUMMARY OF THE INVENTION

An object of the invention is to provide a fiber which does not produce a huge amount of residues during its reducing process, in the field of a polyester fiber.

Another object of the invention is to provide a reducing technique of a polyester fiber without producing a huge amount of the residues.

Another object of the invention is to provide a fiber with good appearance and feeling and superior characteristics as a fiber, such as a high tensile strength and draw ratio.

The invention provides a conjugate fiber comprising a core spinned from a polyester containing an aromatic moiety and a skin layer surrounding the core, the skin layer spinned from an aliphatic polyester.

The invention also provides a reduced conjugate fiber comprising a core spinned from a polyester containing an aromatic moiety and a skin layer which surrounds the core and is spinned from an aliphatic polyester, the skin layer being reduced by contacting it with an alkaline solution or an enzyme.

The inventors succeeded in manufacturing a conjugate fiber comprising a core spinned from a polyester containing an aromatic moiety and a skin layer spinned from an aliphatic polyester, the latter having biodegradability. The inventors further found that the conjugate fiber was reduced under a mild condition by contacting the conjugate fiber, or a cloth knitted from the fiber, with an alkaline solution or an enzyme.

The inventive conjugate fiber and a fabric made thereof after the reduction show good feeling and appearance as a suitable apparel material. Moreover, the decomposition of the aliphatic polyester constituting the skin layer, by means of an enzyme or an alkaline solution, produces products, which may be easily degradable to carbon dioxide or water by means of environmental microorganisms, that is, may be returned to environmental material recycling system. Thus the conjugate fiber and its reducing technique of the invention do not provide any decomposition product needed to be processed as wastes. Therefore, the invention provides a clean reducing technique of a polyester fiber without a waste management problem.

The inventive conjugate fiber, before its reducing process, comprises a surface tissue entirely different from that of a prior polyester containing an aromatic moiety, while maintaining a tensile strength and a tensile elongation comparable with those of such prior polyester. The inventive fiber is thus applicable to a new medical material such as an artificial blood vessel. Moreover, the conjugate fiber may be stretched at a temperature lower than that needed for stretching prior aromatic polyester fibers.

A polyester containing an aromatic moiety, constituting the core, is a polyester comprising an aromatic compound as its monomer. The aromatic compound may preferably be a polyalkylene terephthalate, more preferably be polyethylene terephthalate, polypropylene terephthalate, or polybutylene terephthalate, and most preferably be polyethylene terephthalate or polybutylene terephthalate. An aliphatic polyester constituting the skin layer comprises an aliphatic compound and substantially no aromatic compound as its monomer, and may preferably be polybutylene succinate, polyethylene succinate, poly-L-lactic acid, poly(β-hydroxybutylic acid, poly(β-hydroxybutylic acid/valeric acid), or a copolymer consisting of any combination of the above listed monomers.

When producing the inventive conjugate fiber, a nozzle, first extruder and second extruder are prepared. A core forming space and a skin layer forming space surrounding the core forming space are formed within the nozzle. Melt of a polyester containing an aromatic moiety is supplied into the core forming space and melt of a aliphatic polyester is supplied into the skin layer forming space. The core and skin layer are continuously spinned and formed simultaneously from the spinneret of the nozzle. The inventors found that the thus produced conjugate fiber (before the reducing treatment) had excellent properties needed as a fiber, such as a tensile strength, comparable with those of polyethylelne terephthalate or polybutylene terephthalate fiber.

In the above process, the polyester containing an aromatic moiety may preferably be supplied from a vertical extruder to a nozzle and the aliphatic polyester may preferably be supplied from a horizontal extruder to a nozzle.

The polyester containing an aromatic moiety and aliphatic polyester may be melted in the respective extruders at conventional melting temperatures. The nozzle may preferably be maintained at about 280° C. when spinning the core from polyethylene terephthalate or at about 255° C. when spinning the core from polybutylene terephthalate. The temperature of the nozzle may preferably be further adjusted to stabilize the spinning.

When reducing (the weight of) the conjugate fiber by means of an alkaline solution, to an alkaline solution such as sodium hydroxide or potassium hydroxide solution having a concentration of, for example, 50 weight percent, an equal amount of ethanol or isopropanol may be added to obtain a mixed solution, into which the conjugate fiber is dipped at an appropriate temperature of, for example, 50° C. The enzyme for reducing the conjugate fiber may preferably be Lipase derived from *Pseudomonas cepacia* (such as "Lipase PS" produced by Amano Pharmaceuticals) and Lipase derived from Rizopus Arrhizus (such as "typexI" produced by sigma Inc.) when using polybuthylene succinate, and may preferably be Proteinase K derived from Tritirachium album Limber when using poly-L-lactic acid. The reduction of the conjugate fiber with an enzyme may preferably be carried out at an appropriate pH of, for example, 6 and at an appropriate temperature of, for example, 50° C.

The invention provides a technique to reduce (the weight of) a polyester fiber without providing a large amount of residues as a result of such reducing treatment, or, make it possible to reduce a polyester fiber without providing a large amount of residues. Moreover, the invention provides a fiber with excellent properties needed as a fiber, such as a high tensile strength and an drawing ratio. Moreover, the inventive fiber may be stretched at a temperature lower than that needed for stretching prior aromatic polyester fibers.

EXAMPLES

Example 1

Figure 1A:
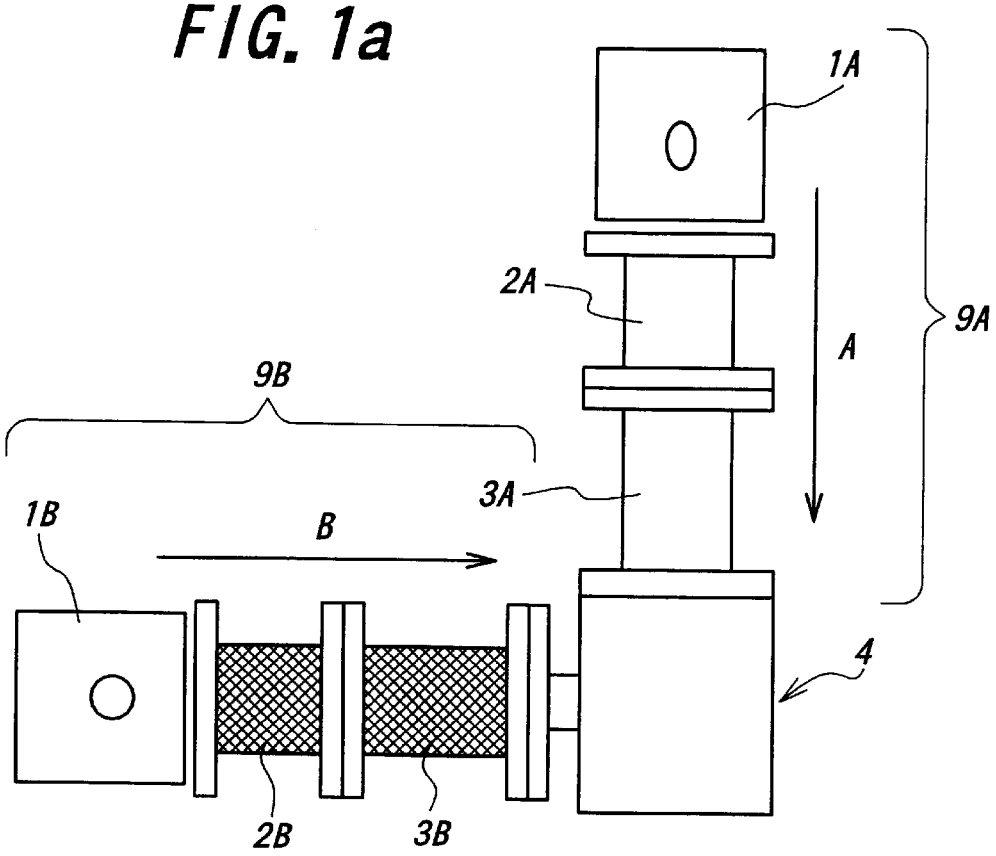
FIG. 1(*a*) is a block diagram schematically showing extruders suited for carrying out the inventive manufacturing method, FIG. 1(*b*) is a diagram schematically showing a nozzle.
Figure 1B:
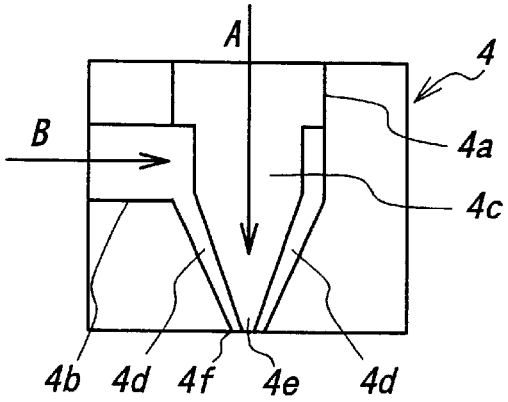

Conjugate fibers were produced using a spinning machine as schematically shown in FIG. 1. Polybutylene terephthalate was melted and extruded through first vertical extruder 9A, and ethylene succinate-L-lactic acid copolymer was melted and extruded through second horizontal extruder 9B, simultaneously, to form the conjugate fiber. Each pellet of each resin was dried for 10 hours in vacuum and supplied into each cylinder 2A and 3A, or 2B and 3B. 1A and 1B are motors. The inlet of the vertical extruder 9A was maintained at 170° C. and the metering portion (melting portion) was maintained at 255° C. The inlet of the horizontal extruder 9B was maintained at 100° C. and the metering portion (melting portion) was maintained at 140° C.

As shown in FIG. 1(*b*), a nozzle 4 comprises connecting portions 4*a* and 4*b* connected with the respective cylinders, a core forming space 4*c*, a skin layer forming space 4*d*, and nozzle spinnerets 4*e* and 4*f*. Melted polybutylene terephthalate was supplied into the nozzle as an arrow "A" and melted ethylene succinate-L-lactic acid copolymer was supplied into the nozzle as an arrow "B". The resulting conjugate fiber was easily and smoothly wound up by a winder when the nozzle was maintained at 255° C. Although melted ethylene succinate-L-lactic acid copolymer decomposes as low as 250° C. in general, actually the viscosity of the melt was not decreased when spinning, supporting that such decomposition did not occur. Maintaining the above described condition, the draw rate of each polymer was maintained at a predetermined rate and the melt draw ratio was changed. As result, unstretched conjugate fibers, in which the contents of polybutylene terephthalate were as high as 70–80 percent, were obtained. Increased melt draw ratio may increase the drawing rate of melted polybutylene terephthalate and decrease the drawing rate of melted ethylene succinate-L-lactic acid copolymer with a relatively low viscosity. The thus obtained three unstretched conjugate fibers were then cold stretched at 70° C. Each draw ratio was maximum ratio (3.5 to 5.1 times) at which each fiber was not broken during the cold drawing.

The above experiments were carried out for both monofilaments and multifilaments. The results were shown in tables 1 and 2. The results concerning the monofilaments were shown in experimental numbers 1, 2 and 3 in table 1, while the results concerning the multifilaments were shown in experimental numbers 4, 5 and 6 in table 2. Tables 1 and 2 show the ratios of the respective polymers (after the cold stretching), the melt draw ratios, tensile strengths, modulus, tensile elongations and diameters of fibers.

TABLE 1

| Experimental number | 1 | 2 | 3 |
|---|---|---|---|
| ethylene succinate-L-lactic acid copolymer (volume %) | 77.0 | 70.0 | 35.0 |
| polybutylene terephthalate (volume %) | 23.0 | 30.0 | 65.0 |
| Melt draw ratio (times) | 13 | 8.7 | 7.1 |
| Draw ratio (times) | 5 | 5 | 5 |
| Tensile strength (Mpa) | 460 | 500 | 740 |
| Modulus (Gpa) | 1.9 | 2.2 | 2.9 |
| Tensile elongation (%) | 40 | 45 | 30 |
| Diameter (μm) | 75 | 125 | 104 |

TABLE 2

| Experimental number | 4 | 5 | 6 |
|---|---|---|---|
| ethylene succinate-L-lactic acid copolymer (volume %) | 12 | 24 | 30 |
| polybutylene terephthalate (volume %) | 188 | 76 | 70 |
| Melt draw ratio (times) | 63 | 35 | 21 |
| Draw ratio (times) | 3.5 | 4.6 | 5.1 |
| Tensile strength (Mpa) | 400 | 590 | 600 |
| Modulus (Gpa) | 2.0 | 2.1 | 1.9 |
| Tensile elongation (%) | 40 | 55 | 50 |
| Diameter (μm) | 25 | 40 | 50 |

As can be seen from tables 1 and 2, when the melt draw rate was increased, the ratio of polybutylene terephthalate, tensile strength and modulus were increased as well as the diameter. Moreover, each conjugate fiber showed properties needed as a fiber comparable with those of a polybutylene terephthelate fiber.

Example 2

Figure 2:
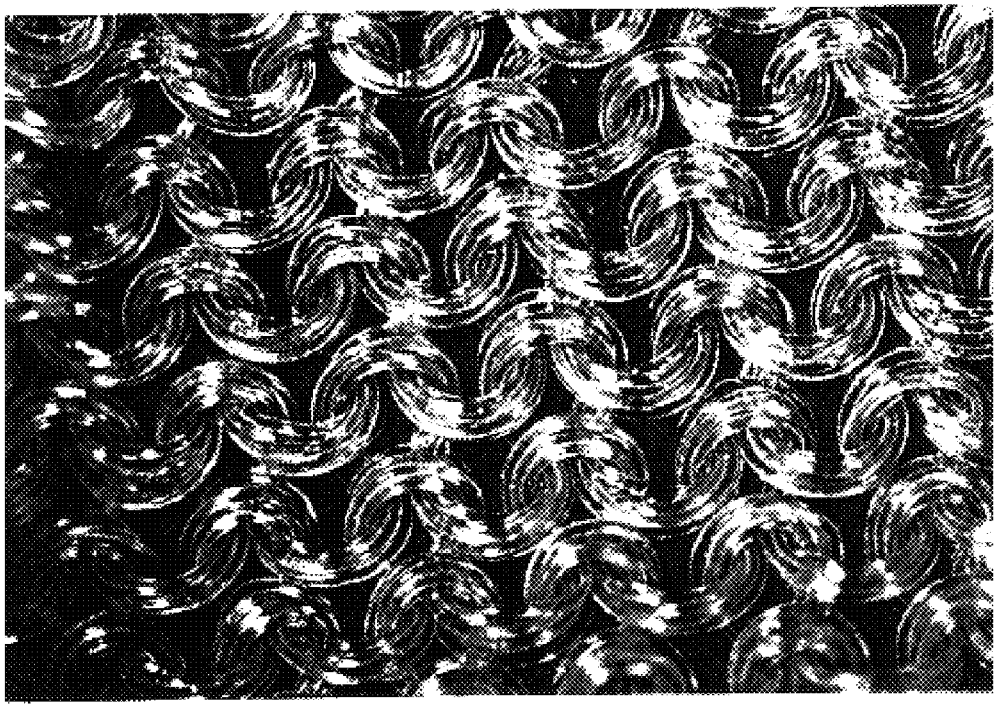
FIG. 2 is a microscopic photograph showing the inventive conjugate fiber before its reducing treatment with an alkali solution.
Figure 3:
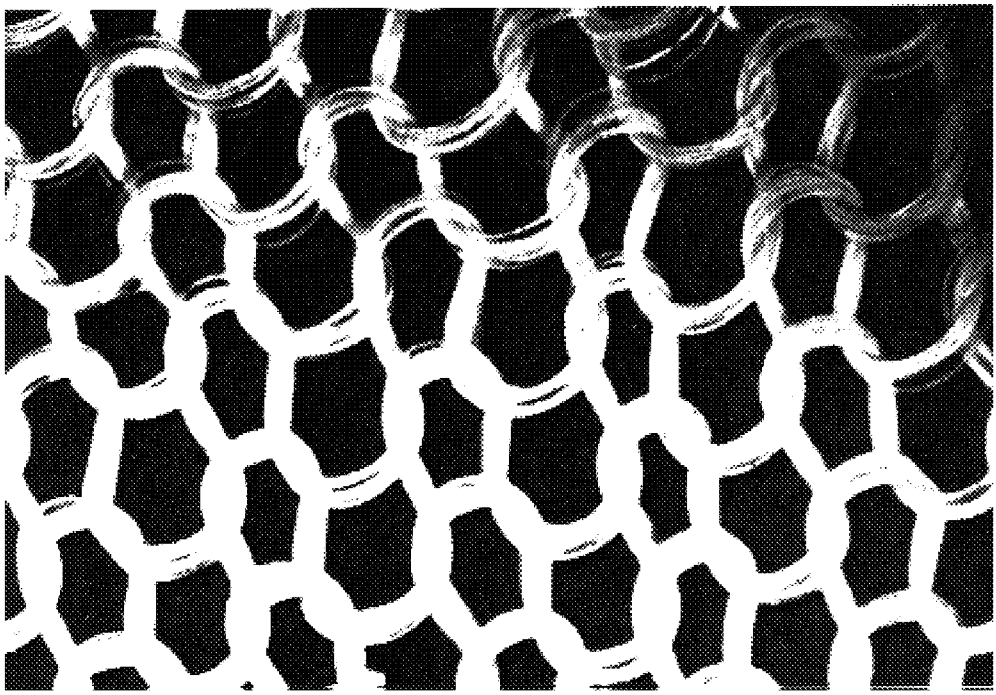
FIG. 3 is a microscopic photograph showing the fiber of FIG. 2 after the reducing treatment.

The stretched fibers of the experimental number 2 in table 1 were circular-knitted to obtain a fabric, which was then dipped into a 25% alkaline solution for 20 minutes to decompose ethylene succinate-L-lacticacid copolymer and reduce the fiber. FIG. 2 is a microscopic photograph showing the fabric before the above reducing treatment, and FIG. 3 is a microscopic photograph showing the fabric after the above reducing treatment. After the reducing treatment, the fiber density of the fabric was decreased, the spaces between the adjacent fibers were widened and its appearance and feeling were improved.

Example 3

Figure 4:
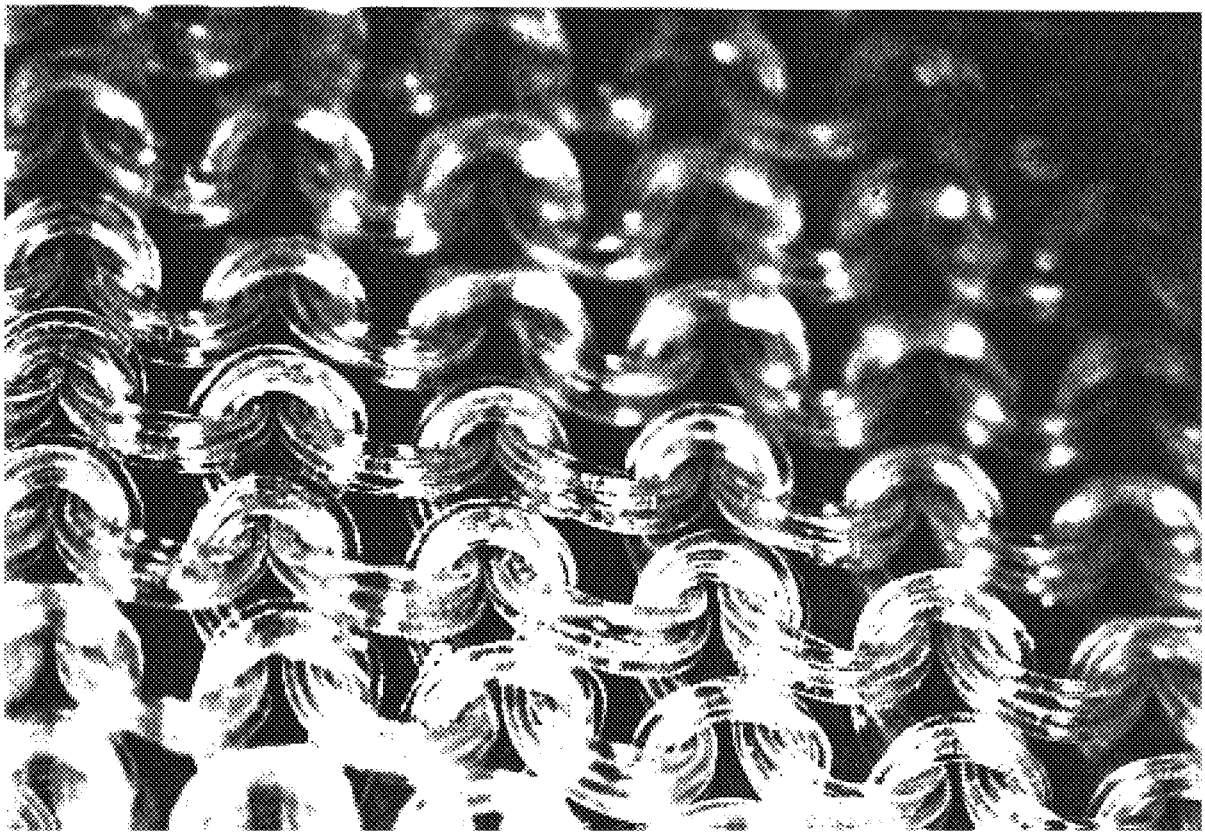
FIG. 4 is a microscopic photograph showing the inventive conjugate fiber before its reducing treatment with an enzyme.
Figure 5:
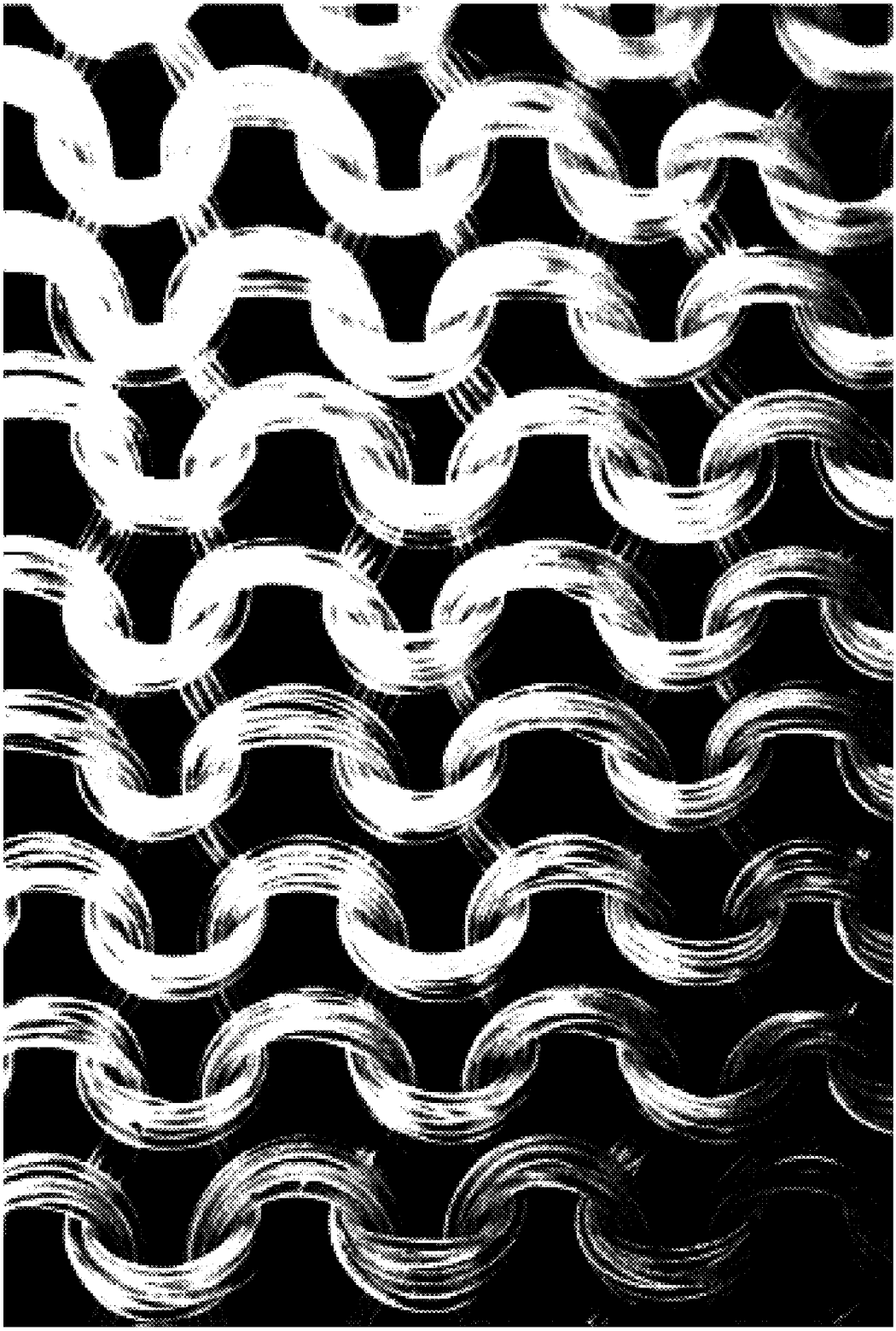
FIG. 5 is a microscopic photograph showing the fiber of FIG. 4 after the reducing treatment for 14 days.

The stretched fibers of experimental number 2 in table 1 were circular-knitted to obtain a fabric, which was then treated with lipase ("Lipase PS" produced by Amano Pharmaceuticals: derived from Pseudomonas). "Lipase PS" was dissolved into a phosphoric acid buffered solution of pH 6.0 at a concentration of 5.0 mg/ml to prepare enzyme solution, to which the fabric was dipped sufficiently. The solution was maintained at 50° C. for 14 days with slow stirring. The fabric was then taken from the solution, washed with water and dried. In the enzyme-treated fabric, same as the above alkaline-treated fabric, the spaces between the adjacent fibers were widen, the fiber density was increased and the appearance and feeling were improved. FIG. 4 is a microscopic photograph showing the fabric before the above reducing treatment with the enzyme, and FIG. 5 is a microscopic photograph showing the fabric after the reducing treatment for 14 days.

Experiment 4

Conjugate fibers of experimental numbers 7 to 10 in table 3 were produced. In table 3, "○" in each column of the corresponding polymer means that the polymer was used as a constituent of each conjugate fiber.

In the experimental number 7, polybutylene terephthalate and polybutylene succinate were used, the supplying portion and the metering portion (melting portion) of a horizontal extruder were maintained at 100° C. and 140° C., respectively, the supplying portion and the metering portion (melting portion) of a vertical extruder were maintained at 190° C. and 250° C., respectively, and the upper portion and the lower portion of a nozzle were maintained at 245° C. and 235° C., respectively.

In the experimental number 8, poly-L-lactic acid and poly-butylene terephthalate were used, the supplying portion and the metering portion (melting portion) of a horizontal extruder were maintained at 100° C. and 140° C., respectively, the supplying portion and the metering portion (melting portion) of a vertical extruder were maintained at 170° C. and 260° C., respectively, and the upper portion and the lower portion of a nozzle were maintained at 245° C. and 240° C., respectively.

In the experimental number 9, poly-L-lactic acid and poly-ethylene terephthalate were used, the supplying portion and the metering portion (melting portion) of a horizontal extruder were maintained at 100° C. and 140° C., respectively, the supplying portion and the metering portion (melting portion) of a vertical extruder were maintained at 230° C. and 300° C., respectively, and the upper portion and the lower portion of a nozzle were maintained at 320° C. and 255° C., respectively.

In the experimental number 10, polyethylene succinate-L-lactic acid copolymer and polyethylene terephthalate were used, the supplying portion and the metering portion (melting portion) of a horizontal extruder were maintained at 100° C. and 130° C., respectively, the supplying portion and the metering portion (melting portion) of a vertical extruder were maintained at 200° C. and 270° C., respectively, and the upper portion and the lower portion of a nozzle were maintained at 290° C. and 265° C., respectively.

Table 3 shows the draw ratios, tensile strengths, moduluses, tensile elongations and diameters of the conjugate fibers of the experimental numbers 7 to 10.

TABLE 3

| Experimental number | 7 | 8 | 9 | 10 |
|---|---|---|---|---|
| Polybutylene succinate | ○ | — | — | |
| Poly-L-lactic acid | — | ○ | ○ | — |
| ethylene succinate-L-lactic acid copolymer | — | — | — | ○ |
| polybutylene terephthalate | ○ | ○ | — | — |
| polyethylene terephthalate (volume %) | — | — | ○ | ○ |

TABLE 3-continued

| Experimental number | 7 | 8 | 9 | 10 |
|---|---|---|---|---|
| Draw ratio (times) | 3 | 6.5 | 6.5 | 5 |
| Tensile strength (Mpa) | 440 | 510 | 400 | 470 |
| Modulus (Gpa) | 3.5 | 3.4 | 1.2 | 3.4 |
| tensile Elongation (%) | 54 | 50 | 40 | 80 |
| Diameter (μm) | 90 | 95 | 80 | 70 |

What is claimed is:

1. A reduced conjugate fiber product for a fabric of an article of apparel, wherein the reduced conjugate fiber comprises a core spun from a polyester containing an aromatic moiety, and a skin layer comprising an aliphatic polyester which surrounds the spun core wherein said aliphatic polyester is biodegradable said skin layer being reduced by contacting said skin layer with an enzyme.

2. The conjugate fiber according to claim 1, wherein the polyester containing an aromatic moiety is selected from the group consisting of polyethylene terephthalate, polypropylene terephthalate and polybutylene terephthalate.

3. The conjugate fiber according to claim 1, wherein the aliphatic polyester is selected from the group consisting of polyethylene succinate, polybutylene succininate, poly-L-lactic acid, poly(β-hydroxybutylic acid) and poly(β-hydroxybutylic acid/valeric acid).

4. The conjugate fiber according to claim 2, wherein the aliphatic polyester is selected from the group consisting of polyethylene succinate, polybutylene succinate, poly-L-lactic acid, poly(β-hydroxybutylic acid) and poly(β-hydroxybutylic acid/valeric acid).

5. The conjugate fiber according to claim 1, wherein the enzyme is selected from the group consisting of lipase and Proteinase K.

6. The conjugate fiber according to claim 4, wherein the enzyme is selected from the group consisting of lipase and Proteinase K.

7. The conjugate fiber according to claim 6, wherein the lipase is derived from *Pseudomonas cepacia* or from Rizopus Arrhizus.

8. The conjugate fiber according to claim 7, wherein the aliphatic acid is polybutylene succinate.

9. The conjugate fiber according to claim 6, wherein the Proteinase K is derived from Tritirachium album Limber.

10. The conjugate fiber as claimed in claim 9, wherein the aliphatic acid is poly-L-lactic acid.

11. A fabric comprising the fiber of claim 1.

12. A fabric comprising the fiber of claim 2.

13. A fabric comprising the fiber of claim 3.

14. A fabric comprising the fiber of claim 4.

15. A fabric comprising the fiber of claim 2.

16. The reduced fiber of claim 1, wherein said core portion is not substantially reduce.

17. The reduced fiber of claim 1, wherein said core is non-biodegradable.

* * * * *